US007744399B1

(12) United States Patent
Gibbs et al.

(10) Patent No.: US 7,744,399 B1
(45) Date of Patent: Jun. 29, 2010

(54) CABLE END RETENTION CLIP

(75) Inventors: Ronald Thomas Gibbs, Paoli, PA (US); Terry Louth, Narvon, PA (US); Peter P. Klein, Phoenixville, PA (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 12/330,864

(22) Filed: Dec. 9, 2008

(51) Int. Cl.
*H01R 13/627* (2006.01)

(52) U.S. Cl. ..... 439/362; 439/372

(58) Field of Classification Search ..... 439/362, 439/372

See application file for complete search history.

(56) References Cited

U.S. PATENT DOCUMENTS

| | | | | | |
|---|---|---|---|---|---|
| 3,764,957 | A * | 10/1973 | Iversen | 439/362 |
| 5,256,085 | A * | 10/1993 | Tan et al. | 439/607.4 |
| 5,375,036 | A * | 12/1994 | Magdaleno | 361/673 |
| 5,924,886 | A * | 7/1999 | Achammer et al. | 439/372 |
| 6,176,728 | B1 * | 1/2001 | Bonnet et al. | 439/362 |
| 6,270,368 | B1 * | 8/2001 | Duval | 439/211 |
| 6,475,017 | B1 * | 11/2002 | Wu | 439/372 |
| 6,821,159 | B2 * | 11/2004 | Munger et al. | 439/680 |
| 6,851,958 | B1 * | 2/2005 | Rowland et al. | 439/142 |
| 7,134,902 | B1 * | 11/2006 | Lewis et al. | 439/373 |
| 2007/0054676 | A1 | 3/2007 | Duan | |

OTHER PUBLICATIONS

Examiner's Office Letter in Japanese Patent Application No. 2006-542691 dated Sep. 7, 2009.
JP Laid-Open Gazette No. 2004-158947 (English abstract only).
JP Laid-Open Gazette No. 2007-507123 (counterpart English text US Patent Application No. 2007/0054676).
T. Hattori, "Wireless Broadband Textbook," IDG Japan, Jun. 10, 2002, p. 142-p. 143. (no. English text).

* cited by examiner

*Primary Examiner*—Truc T Nguyen
(74) *Attorney, Agent, or Firm*—Richard J. Gregson; Robert P. Marley

(57) ABSTRACT

A connector assembly is provided having a cable end plug with a body adapted to be connected to a cable with a connector part, and at least one outwardly extending flange on the body. A mating receptacle receives the cable end plug. The receptacle has a body with a complementary connector part to the cable end plug connector part. A retention clip is connected to the receptacle body, and includes at least one spring arm extending outwardly therefrom with a distal entry ramp portion, a retaining shoulder portion and a flange receiving portion. A thickness of the flange is approximately equal to a depth of the flange receiving portion so that the retaining shoulder portion engages behind the flange in a connected position of the cable end plug in the mating receptacle. For release, the retaining shoulder can be set at an angle of at least 94° to the flange receiving portion to form a release ramp that allows disengagement when a sufficiently high predetermined release force is applied to the cable end plug. Alternatively, the retaining shoulder is set at about 90° and ejector tabs are provided on the cable end plug to disengage the spring arms.

11 Claims, 3 Drawing Sheets

CABLE END RETENTION CLIP

FIELD OF INVENTION

The invention relates to the field of cables for various computer, telecommunication and/or electronic devices, and in particular to a cable end retention system for securely holding a cable end connection part securely to a mating connection part.

BACKGROUND

Cables are used in various applications for power and/or signal transmission. For large computer systems, many densely packed cables are often required and are typically difficult to access. It is common for the cable end plug, whether male, female or a combination thereof, to have screws to retain them in the mating plug receptacle. However, these screws are hard for a technician to access, either with their fingers or a tool, and are typically difficult to see for installation and removal. Further, with threaded fasteners, there is always the possibility of cross-threading and jamming the cable end plug in a partially installed position, making it difficult or impossible to remove without damaging either the end plug or back plate, or both. Typically, the technician then just leaves the cable end plug pressed in the mating receptacle, but not anchored, which can result in inadvertent disconnection in the future.

It would be desirable to provide a cable end connection part that provides a secure attachment, which is easier for a user to install or remove without damaging the end connection part or the mating part on a computer or other electronic system.

SUMMARY

A connector assembly is provided having a cable end plug with a body adapted to be connected to a cable and a connector part At least one outwardly extending flange is located on the body. A mating receptacle receives the cable end plug. The receptacle has a body with a complementary connector part to the cable end plug connector part. A retention clip is connected to the receptacle body, and includes at least one spring arm extending outwardly therefrom with a distal entry ramp portion, a retaining shoulder portion and a flange receiving portion. A thickness of the flange is approximately equal to a depth of the flange receiving portion so that the retaining shoulder portion engages behind the flange in a connected position of the cable end plug in the mating receptacle.

In a preferred embodiment, the cable end plug includes flanges on opposing sides, and the retention clip on the receptacle includes two spring arms in complementary positions to the flanges, such that the cable end plug can be firmly engaged with and retained on the receptacle in the assembled position of the connector assembly.

For release, the retaining shoulders of the spring arms are set at an angle of at least 94° to the flange receiving portion to form a release ramp that allows disengagement when a sufficiently high predetermined release force is applied to the cable end plug in a direction away from the receptacle, causing the spring arms to resiliently deflect outwardly and release the respective flanges.

Alternatively, the retaining shoulder is set at about 90° and ejector tabs are provided on the cable end plug to disengage the spring arms. For release, the ejector tabs are displaced inwardly to resiliently deflect the spring arms outwardly, while simultaneous application of a release force on the plug in a direction away from the receptacle results in the cable end plug becoming disengaged.

For assembly, the distal entry ramp portions of the spring arms cause the spring arms to resiliently deflect outwardly as the cable end plug engages and is pushed into the receptacle, until the flanges pass the retaining shoulder portions and the spring arms resiliently spring inwardly, with the retaining shoulder portions engaging behind the respective flanges.

BRIEF DESCRIPTION OF THE DRAWING(S)

The foregoing Summary and the following detailed description will be better understood when read in conjunction with the appended drawings, which illustrate preferred embodiments of the invention. In the drawings.

DETAILED DESCRIPTION OF THE PREFERRED EMBODIMENTS

Figures 1, 2:
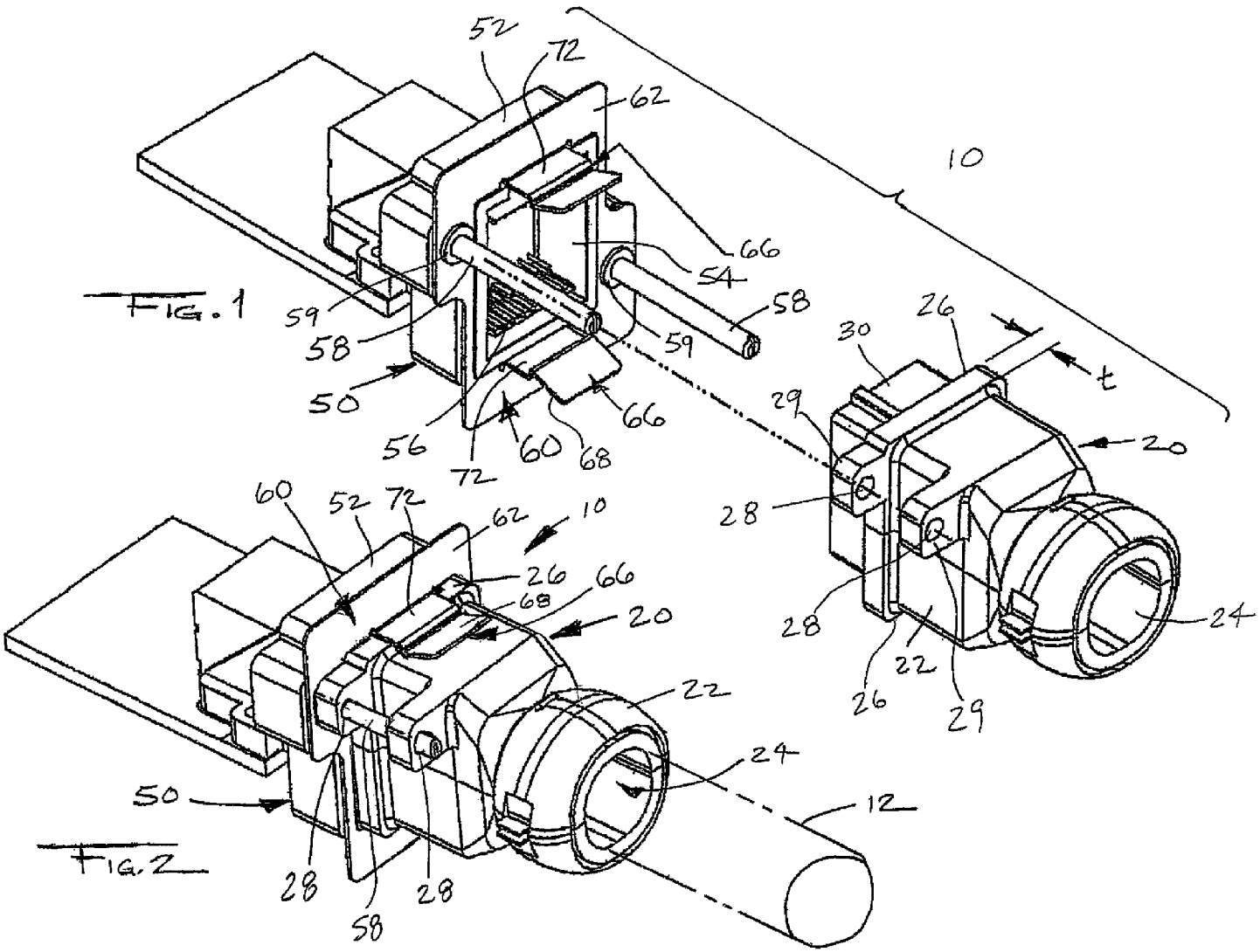
FIG. 1 is a perspective view of a first embodiment of a connector assembly according to the invention shown with the cable end plug disengaged from the receptacle.
FIG. 2 is a perspective view of the connector assembly of FIG. 1 shown in the assembled state.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b or c" (where a, b and c represent the items being listed) means any single one of the items a, b or c, or combinations thereof. The terminology includes the words specifically noted above, derivatives thereof and words of similar import.

Referring to FIGS. 1-4, a first embodiment of a connector assembly 10 in accordance with the present invention is shown. The connector assembly 10 includes a cable end plug 20 and a mating receptacle 50, which can be mounted on a computer back plane or utilized in connection with other electronic components, that receives the cable end plug 20. The cable end plug 20 is adapted to be connected to a cable 12 shown in FIG. 2, and includes an electrical connector part 30 having contacts configured as sliding contacts, pins, or receptacles, which can be in any desired configuration. These contacts are connected to individual wires in the cable 12 in a known manner. The cable end plug 20 includes a body 22, which is preferable a molded polymeric part. The body 22 can be molded in two halves that are assembled around the cable 12. An opening 24 is provided at one end for the cable 12. Preferably, at least one flange 26 extends outwardly from the body 22. As shown in FIGS. 1 and 2, preferably a flange 26 extends from both the top and bottom, as well as the front and back sides of the body 22.

While not required, preferably the cable end plug body 22 includes guide holes 28 formed in tabs extending from both sides of the body 22. The tabs 29 are only shown on the upper left side of the cable end plug body 22 and a similar pair of tabs, preferably extend from the lower right side in a complementary position to the guide pins 58 of the receptacle 50, which are described in further detail below. However, the tabs on one or both sides, along with the guide holes can be eliminated, depending upon the specific connector configuration.

Still with references to FIGS. 1 and 2, the mating receptacle 50 receives the cable end plug 20 and retains it in position once it is inserted. The receptacle 50 includes a body 52, which is preferably molded from a polymeric material and includes a mating connector part 54, shown as an opening for receiving the connector part 30 of the cable end plug 20. Mating contacts 56 are provided in complementary positions in the connector part 54. While the illustrated contacts 56 and connector part 54 are in the form of a female plug with sliding contacts, those skilled in the art will recognize that any type of sliding, male and/or female contacts, and/or combinations thereof, can be provided.

Guide pins 58 extend from a side of the connector body facing the cable end plug 20 and are aligned in complementary positions to the guide holes 28 on the cable end plug body 22. A retention clip 60 is connected to the receptacle 50, preferably via clip retainers 59 located at the base of the guide pins 58 which hold the retention clip 60 in position against the body 52. In a preferred embodiment, the guide pins 58 include threaded ends which are received in counter-threaded holes in the receptacle body 52, and the clip retainers 59 are formed on the guide post 58. Alternatively, the guide pins 58 can be connected to the body 52 via any other method, such as being molded in position as the body 52 is formed, and the clip retainers 59 may be formed as separate washer-shaped elements which are pressed into position over the guide pins 58 after the installation of the retention clip 60.

Figure 4:
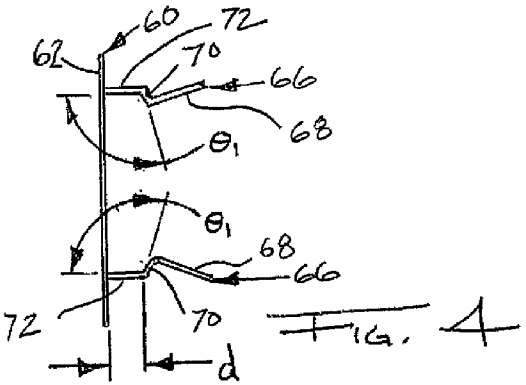
FIG. 4 is a side elevational view of the retention clip shown in FIG. 3.
Figure 3:
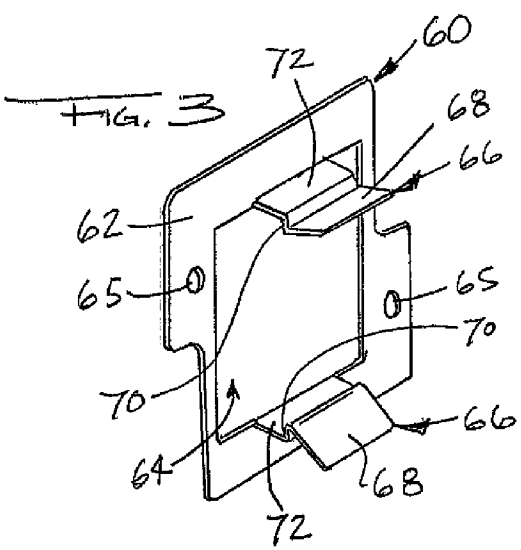
FIG. 3 is a perspective view of a retention clip used in connection with the connector assembly of FIG. 1.

As shown in FIGS. 3 and 4, the retention clip 60 includes a base 62, preferably formed of sheet metal. A center opening 64 is provided which is complementary in shape to or has a greater opening than the opening forming the connector part 54 of the receptacle 50. At least one spring arm 66 extends outwardly from the base 62 of the retention clip 60. In the preferred embodiment, as illustrated, spring arms 66 are located on the upper and lower sides of the center opening 64 and each include a distal entry ramp portion 68 which is angled to form a ramped opening leading to the receptacle 50. As shown in detail in FIG. 4, a retaining shoulder portion 70 and a flange receiving portion 72 are located between the distal ramp portion 68 and the base 62. The flange receiving portion 72 has a length that is approximately equal to a thickness T of the flange 26 (indicated in FIG. 1) on the cable end plug body 22, which in the preferred embodiment is about 0.160 inches. This allows the retaining shoulder portion 70 to engage behind the flange 26 in a connected position of the cable end plug 20 and the mating receptacle 50.

Preferably, the retaining shoulder portion 70 has a length that is less than or equal to a distance which the flange 26 protrudes from the body 22 of the cable end plug 20, allowing the retaining shoulder portion 70 to fully engage behind the flange 26. As shown, preferably there are two of the outwardly extending flanges 26 on the cable end plug 20 which are located on opposite sides of the body 22, and there are two of the spring arms 66, with each engaging a respective one of the flanges 26 in the connected position, as shown in FIG. 2. However, those skilled in the art will recognize that one spring arm 66 and flange 26 may be sufficient, or three or more spring arms 66 and complementarily located flanges 26 can be utilized depending on the retention properties desired for the connector assembly.

As shown in FIG. 4, the retaining shoulder portion 70 of the spring arm 66 are set at an angle of $\theta_1$ which is at least 94 degrees with respect to the flange receiving portion 72, in order to form a release ramp such that the spring arms 66 are automatically deflected outwardly and over the flanges 26 upon application of a sufficient release force on the cable end plug 20 in a direction away from the receptacle 50. This force can be adjusted depending upon the angle $\theta_1$, which in the preferred embodiment is between 94° and 95°, as well as the thickness and spring constant of the spring arm 66.

In the preferred embodiment, the retention clip 60 is formed from a stamped sheet metal part in which the spring arms 66 are bent up from the base 62, and the retention clip 60 is then heat treated and tempered in order to provide the spring arms 66 with the desired flexibility. In the preferred embodiment, the retention clip 60 is made from 302 or 2304 CSP stainless spring steel having a thickness of approximately 0.020 inches (0.5 mm), although other sizes may be used.

In order to assemble the connector assembly 10, the cable end plug 20 is aligned with the guide holes 28 in complementary positions to the guideposts 58 on the receptacle 50. The cable end plug 20 with the attached cable 12 is then pressed onto the receptacle 50 with the guide pins 58 entering the guide holes 28 and the connector part 30 of the cable end plug 20, matingly engaging with the connector part 54 of the receptacle 50. As the user continues to press the cable end plug 20 into the receptacle 50, the entry ramp portion 68 of the spring arm 66 contact the flanges 26 on the top and bottom sides of the cable end plug 20, causing the spring arms 66 to deflect outwardly. As the flanges 26 pass the retaining shoulder portion 70 of the spring arm 66, the spring arms 66 resiliently spring back inwardly and engage behind the flanges 26, such that the flanges 26 are located within the flange receiving portions 72 of the spring arms 66.

In order to disengage the cable end plug 20, a sufficient force is provided on the cable end plug 20 in a direction away from it the receptacle 50 which is transferred via the flanges 26 to the angled retaining shoulder portions 70 of the spring arms 66, causing the spring arms 66 to deflect outwardly once a sufficient force is applied to spread the spring arms 66 of the retention clip 60. At this point, the flanges 26 slide beneath the retaining shoulder portion 70 of the spring arms and the cable end plug 20 is disengaged.

Referring now to FIGS. 5-10, a second embodiment of the connector assembly 110 is shown. The connector assembly 110 is similar to the connector assembly 10, and includes the cable end plug 120 which is attached to the receptacle 150 which can be mounted on a computer back plane or utilized in connection with other electronic components. The cable end plug 120 includes the body 122 with a cable opening 124 in which the cable 112 can be attached. The body 122 can be formed in two halves and assembled about the cable 112, or could be molded over the cable 112. The cable end plug body 122 includes flanges 126 which are similar to the flanges 26 described in connection with the first embodiment 10 and also includes guide holes 128 for guiding the cable end plug 120 into the connected position utilizing guide pins 158 which extend from the receptacle 150, as described in detail below. The cable end plug 120 includes a connector part 130, which can include, male, female or slide connectors which are used to make the electrical connection with contacts 156 in the complementary connector part 154 of the receptacle 150.

Figure 8:
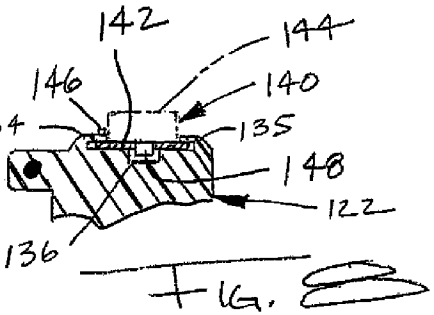
FIG. 8 is a partial cross-sectional view taken along lines 8-8 in FIG. 5.
Figures 5, 6:
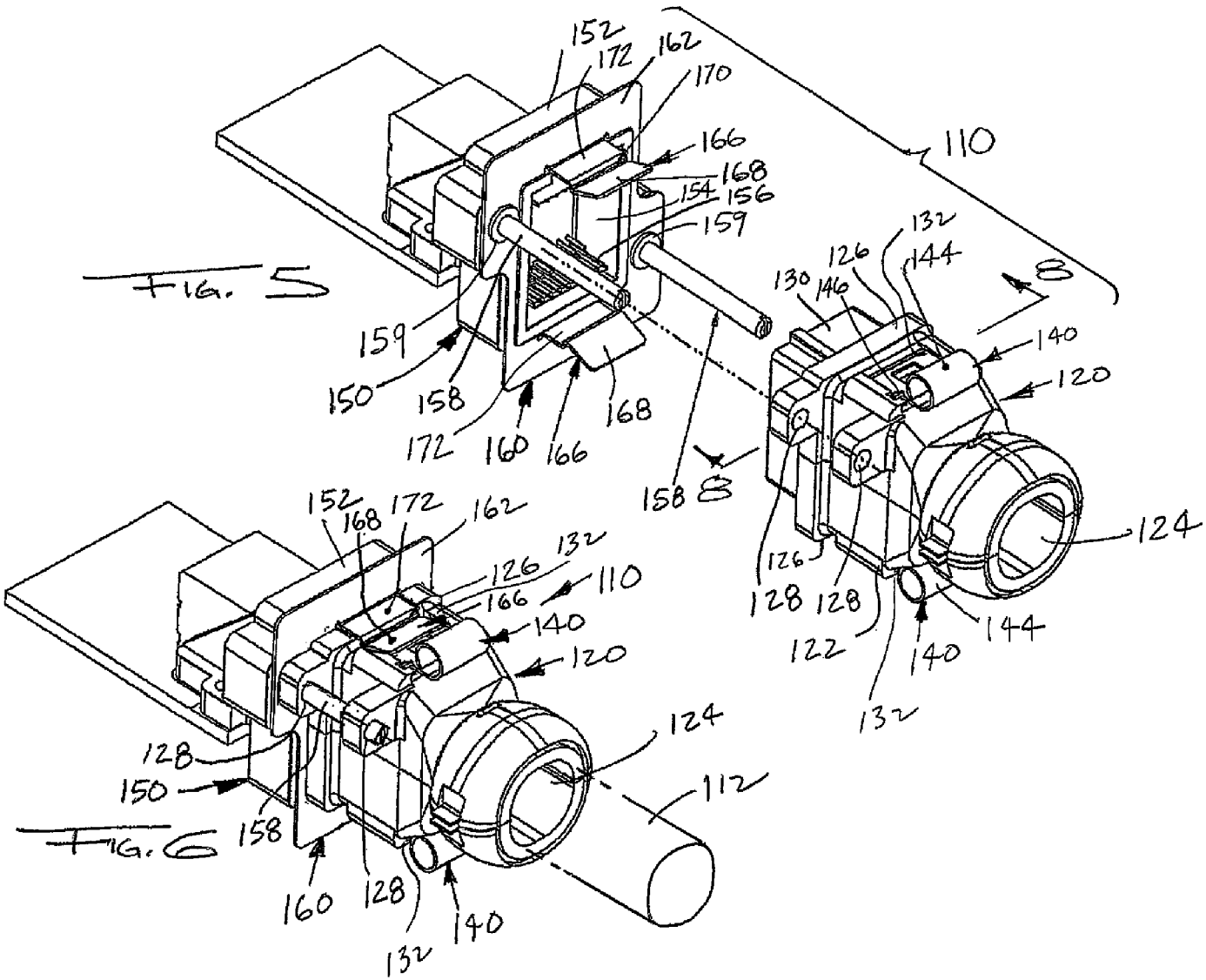
FIG. 5 is a perspective view of a second embodiment of a connector assembly according to present invention shown in a disassembled state.
FIG. 6 is a perspective view of the connector assembly of FIG. 5 shown in the assembled state.

The connector assembly 110 differs from the first embodiment of the connector assembly 10 in that the cable end plug 120 includes slide channels 132, preferably on the top and bottom surfaces, which are formed via channel sides 134, 135, which are shown in detail in FIG. 8. Each of the channel sides 134, 135 is L-shaped and defines an overall C-shaped section in connection with adjacent portion of the body 122 of the cable end plug 120. FIG. 8 shows the slide channel 132 located on top of the cable end plug body 122, and a mirror symmetric arrangement would be provided on the bottom of the body 122 of the plug 120 as indicated in FIGS. 5 and 6. A central groove 136 is provided inside the slide channel 132 which receives a central protrusion 148 of an ejector tab 140 slidably positioned within the slide channel 132.

Figure 9:
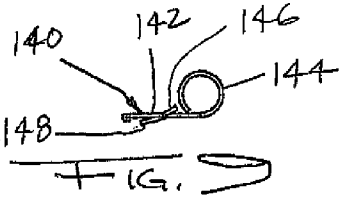
FIG. 9 is a side elevational view of the ejector tab used in the connector assembly shown in FIG. 5.
Figure 7:
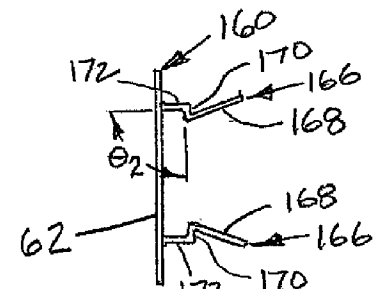
FIG. 7 is a side elevational view of the retention clip used in the connector assembly according to FIG. 5.
Figure 10:
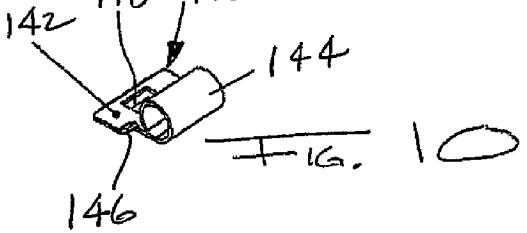
FIG. 10 is a perspective view of the ejector tab shown in FIG. 9.

Referring to FIGS. 9 and 10, the ejector tab 140 is shown in detail and includes a slide body 142, preferably formed from punched and bent-up sheet metal, having an end protrusion 144 formed as a rolled segment of the body 142. A retaining clip 146 is bent upwardly from at least one of the sides of the slide body 142 and, as shown in detail in FIGS. 5 and 6, acts as a stop to prevent the ejector tab 140 from sliding all the way out of the slide channel 132 once it has been installed. Preferably, the retaining clip 146 is sufficiently flexible and resilient that the ejector tab can be slid into position in the slide channel 132 with the retaining clip 146 resiliently deflecting downwardly into the slide channel 132 and is resiliently biased upwardly against the inside top of the L-shaped channel side 134. When the ejector tab 140 is pressed inwardly, the retaining clip 146 resiliently deflects downwardly such that the ejector tab 140 can be pushed toward the mating end of the cable end plug 120. A center protrusion 148 extends downwardly from the slide body 142 into the groove 136 in the body 122 and prevents the ejector tab 140 from being pushed to far in a direction toward the connector part 130 of the cable end plug 120.

Referring again to FIGS. 5 and 6, the receptacle 150 of the second embodiment of the connector assembly 110 is similar to the receptacle 50 described in connection with the first embodiment, and includes a body 152 as well as a mating connector part 154 having contacts located in complementary positions to the contacts of the connector part 130 of the cable end plug 120. Guide pins 158 are provided in a similar manner to the guide pins 58 described above and a retention clip 160 is attached to the receptacle 150 via retainers 159 on the guide pins 158.

The retention clip 160 is similar to the retention clip 60 described above and includes a base 162 having a center opening 164 and spring arms 166 that include an entry ramp portion 168, a retaining shoulder portion 170 and a cable end plug flange receiving portion 172. The flange receiving portion 172 has a length that is approximately equal to the thickness of the flange 126 on the cable end plug 120. As shown in detail in FIG. 7, the retaining shoulder portion is bent at an angle of $\theta_2$ of about 90° relative to the flange receiving portion 172. The entry ramp portions 168 are bent outwardly, preferably at an angle 5° or greater, relative to a longitudinal center line extending parallel to the guide pins 158. The retaining shoulder portion 170 preferably has a depth that is equal to or less than the height that the flange 126 protrudes from the body 122 of the cable end plug 120. As shown, there are preferably two opposing spring arms 166 on the receptacle for engaging flanges 126 located on the top and bottom of the cable end plug 120.

In order to assemble the connector assembly 120, the cable end plug 120 is aligned with the receptacle 150 and the guide pins 158 are guided into the guide holes 128 to align the cable end plug 120 with the receptacle 150. The connector part 130 on the cable end plug 120 then matingly engages the connector part 154 of the receptacle as a user continues to press the cable end plug into the receptacle 150 while simultaneously the entry ramp portions 168 of the spring arms contact the flanges 126 on the top and bottom of the connector end plug 120 and are resiliently flexed outwardly as the two parts are pressed together. Once the flanges 126 cross the retaining shoulder portions 170 of the spring arms 166, the spring arms 166 resiliently flex inwardly with the retaining shoulder portions 170 engaging behind the flanges 126 in order to securely hold the cable end plug 120 in contact with the receptacle 150.

While the preferred angle $\theta_2$ is approximately equal to 90°, those skilled in the art will recognize that angles less than 90° between the retaining shoulder portion 170 and the flange receiving portion 172 can be utilized to still provide a hooking action of the retaining shoulder portion 170 behind the flange 126. Contrary to the first embodiment of the connector assembly 10, the use of this angle does not provide any ramp portion to assist in the extraction of the cable end plug 120 from the receptacle by the mere application of a force on the cable end plug 120 in a direction away from the receptacle 150. Rather, in this case, in order to remove the cable end plug 120 from the receptacle 150 to disconnect the connector assembly 110, a user is required to place a finger and thumb on the top and bottom sides of the body 122 of the cable end plug 120 and press inwardly with both the forger and thumb in order to press the top and bottom ejector tabs 140 in a direction toward the receptacle 150. The rounded end protrusions 144 contact the entry ramp portions 168 of the spring arms as the user rolls both their finger and thumb forward and inwardly toward each other pressing the ejector tabs 140 inwardly while at the same time pulling in the opposite direction on the body 122 of the cable end plug 120 in a direction away from the receptacle 150. The spring arms 166 are directly outwardly opposite from one another via contact with the end protrusions 144, and the retaining shoulder portion 170 on each of the spring arms is resiliently reflected sufficiently to release the flanges 126 on the top and bottom of the cable end plug 120 so that it can be withdrawn from the receptacle 150, disconnecting the connector parts 130 and 154 from one another.

Preferably, the retention clip 160 is formed from a punched and bent-up sheet metal part that is then heat treated and tempered in order to provide the desired spring properties for the spring arms 166.

In both preferred embodiment, the height of the retaining shoulder portion 70, 170 on the retention clip 60, 160 is 0.190 inches (4.83 mm). Additionally, the height of the flange 26, 126 is 0.187 inches (4.76 mm). Preferably, for the retention clips 60, 160, the thickness of the sheet metal is 0.020 inches (0.5 mm) and the material is 302 or 304CSP stainless spring steel. The length of the flange receiving portion 72, 172 is greater than the thickness T of the flange 26, 126, which is approximately 0.160 inches in the preferred embodiment.

While the preferred embodiments of the connector assemblies 10, 110 include spring clips having spring arm 66, 166 which are located on opposite sides of the receptacle 50, 150, those skilled in the art will recognize that the invention could utilize a single spring arm 66, 166 that engages a single flange 26, 126 on the cable end plug 20, 120 or could utilize multiple spring arms 66, 166 that engage multiple flanges 26, 126, depending upon the withdrawal force desired, especially in connection with the first embodiment of the connector assembly 10.

While the invention has been described in terms of two preferred embodiments, further changes and modifications can be made without departing from the scope of the present invention as defined by the appended claims.

What is claimed is:

1. A connector assembly, comprising:

a cable end plug having a body adapted to be connected to a cable with a connector part, and at least one outwardly extending flange on the body, the flange having a thickness;

a mating receptacle that receives the cable end plug, the receptacle having body with a complementary connector part to the cable end plug connector part, and a retention clip connected to the receptacle body, the retention clip including at least one spring arm extending outwardly therefrom with a distal entry ramp portion, a retaining shoulder portion and a flange receiving portion, wherein a thickness of the flange is approximately equal to a depth of the flange receiving portion so that the retaining shoulder portion engages behind the flange in a connected position of the cable end plug in the mating receptacle;

further comprising guide posts extending from the receptacle body, the retention clip including complementary openings to the guide posts and being located over the guide posts in a position against the receptacle body, and retainers being located on the guide posts that hold the retention clip against the receptacle body.

2. The connector assembly of claim 1, wherein the retaining shoulder portion has a length that is less than or equal to a distance which the flange protrudes from the body of the cable end plug.

3. The connector assembly of claim 1, wherein there are two of the outwardly extending flanges on the cable end plug located on opposite sides of the body, and there are two of the spring arms, each engaging a respective one of the flanges in the connected position.

4. The connector assembly of claim 1, wherein the retaining shoulder portion of the at least one spring arm is set at an angle of at least 94° with respect to the flange receiving portion, forming a release ramp such that the at least one spring arm is automatically deflected outwardly and over the at least one flange upon application of a release force on the cable end plug in a direction away from the receptacle.

5. The connector assembly of claim 4, wherein the angle is between 94° and 95°.

6. The connector assembly of claim 1, wherein the retention clip is formed of a bent-up sheet metal part.

7. A connector assembly, comprising:

a cable end plug having a body adapted to be connected to a cable with a connector part, and at least one outwardly extending flange on the body, the flange having a thickness;

a mating receptacle that receives the cable end plug, the receptacle having body with a complementary connector part to the cable end plug connector part, and a retention clip connected to the receptacle body, the retention clip including at least one spring arm extending outwardly therefrom with a distal entry ramp portion, a retaining shoulder portion and a flange receiving portion, wherein a thickness of the flange is approximately equal to a depth of the flange receiving portion so that the retaining shoulder portion engages behind the flange in a connected position of the cable end plug in the mating receptacle;

wherein the retaining shoulder portion of the at least one spring arm is set at an angle of about 90° with respect to the cable end plug flange receiving portion, and the cable end plug body including at least one ejector tab that is displaceable on the cable end plug body to engage and deflect the at least one spring arm outwardly and over the at least one flange upon application of a pressing force on the ejector tab in conjunction with an oppositely directed release force on the cable end plug in a direction away from the receptacle.

8. The connector assembly of claim 7, wherein there are two of the spring arms, one located opposite the other on the receptacle, there are two of the flanges located in complementary positions on the cable end plug body, and there are two of the ejector tabs, each being located in a complementary position to one of the spring arms, and the ejector tabs are displaceable on the cable end plug body to engage and deflect the two spring arms outwardly and over the two flanges upon application of a pressing force on the two ejector tabs in conjunction with an oppositely directed release force on the cable end plug in a direction away from the receptacle.

9. The connector assembly of claim 8, wherein the ejector tabs are slideably displaceable.

10. The connector assembly of claim 7, wherein the ejector tab includes a cylindrical-shaped end protrusion that is adapted to engage the spring arm.

11. The connector assembly of claim 7, wherein the receptacle body includes a slide channel defined by two channel sides, and the at least one ejector tab is slidable in the slide channel and includes a retaining clip that engages in a recess in one of the channel sides.

* * * * *